US007955443B2

(12) United States Patent
Nakamura et al.

(10) Patent No.: US 7,955,443 B2
(45) Date of Patent: Jun. 7, 2011

(54) METHOD FOR PREPARING RARE EARTH PERMANENT MAGNET MATERIAL

(75) Inventors: Hajime Nakamura, Echizen (JP); Takehisa Minowa, Echizen (JP); Koichi Hirota, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 464 days.

(21) Appl. No.: 11/783,639

(22) Filed: Apr. 11, 2007

(65) Prior Publication Data

US 2007/0240788 A1 Oct. 18, 2007

(30) Foreign Application Priority Data

Apr. 14, 2006 (JP) ..... 2006-112327
Apr. 14, 2006 (JP) ..... 2006-112342

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS 4,837,114 A * 6/1989 Hamada et al. ..... 427/527
4,917,778 A * 4/1990 Takada et al. ..... 205/181
4,942,098 A 7/1990 Hamamura et al.
4,968,529 A 11/1990 Hamamura et al.
4,981,532 A * 1/1991 Takeshita et al. ..... 148/302
5,034,146 A 7/1991 Ohashi et al.
5,194,099 A 3/1993 Esper et al.
5,316,595 A 5/1994 Hamada et al.
5,405,455 A 4/1995 Kusunoki et al.
5,411,603 A 5/1995 Vial et al.
5,580,396 A * 12/1996 Fruchart et al. ..... 148/101
5,766,372 A 6/1998 Fujimura et al.
5,851,312 A * 12/1998 Honkura et al. ..... 148/122
5,858,123 A 1/1999 Uchida et al.
5,858,124 A 1/1999 Endo et al.
6,296,720 B1 10/2001 Yamamoto et al.

(Continued)

FOREIGN PATENT DOCUMENTS

EP 0255939 A2 2/1988

(Continued)

OTHER PUBLICATIONS

The Journal of the Institute of Electrical Engineers of Japan, vol. 124, 2004, pp. 699-702, published on Nov. 1, 2004.

(Continued)

*Primary Examiner* — John P Sheehan
(74) *Attorney, Agent, or Firm* — Westerman, Hattori, Daniels & Adrian, LLP

(57) ABSTRACT

A permanent magnet material is prepared by covering an anisotropic sintered magnet body of formula: $R^1_x(Fe_{1-y}Co_y)_{100-x-z-a}B_zM_a$ wherein $R^1$ is a rare earth element, M is Al, Cu or the like, with a powder comprising an oxide of $R^2$, a fluoride of $R^3$ or an oxyfluoride of $R^4$ wherein $R^2$, $R^3$, and $R^4$ are rare earth elements, and having an average particle size up to 100 μm, heat treating the powder-covered magnet body in a hydrogen gas-containing atmosphere for inducing disproportionation reaction on $R^1_2Fe_{14}B$ compound, and continuing heat treatment at a reduced hydrogen gas partial pressure for inducing recombination reaction to said compound, thereby finely dividing said compound phase to a crystal grain size up to 1 μm, and for effecting absorption treatment, thereby causing $R^2$, $R^3$ or $R^4$ to be absorbed in the magnet body.

24 Claims, 1 Drawing Sheet

U.S. PATENT DOCUMENTS

| | | | | |
|---|---|---|---|---|
| 6,302,939 | B1 | 10/2001 | Rabin et al. | |
| 6,403,024 | B1 * | 6/2002 | Oota et al. | 419/33 |
| 6,606,019 | B1 | 8/2003 | Ohashi | |
| 6,960,240 | B2 | 11/2005 | Hirota et al. | |
| 7,053,745 | B2 | 5/2006 | Yoshimura et al. | |
| 7,138,018 | B2 | 11/2006 | Honkura et al. | |
| 7,485,193 | B2 | 2/2009 | Hirota et al. | |
| 7,559,996 | B2 | 7/2009 | Miyata et al. | |
| 2003/0047240 | A1 | 3/2003 | Honkura et al. | |
| 2003/0079805 | A1 | 5/2003 | Hamada et al. | |
| 2004/0000359 | A1 | 1/2004 | Tayu et al. | |
| 2004/0187970 | A1 | 9/2004 | Ishizaka et al. | |
| 2006/0213582 | A1 | 9/2006 | Nakamura et al. | |
| 2006/0213583 | A1 | 9/2006 | Nakamura et al. | |
| 2006/0213584 | A1 | 9/2006 | Nakamura et al. | |
| 2006/0213585 | A1 | 9/2006 | Nakamura et al. | |
| 2006/0278517 | A1 | 12/2006 | Machida et al. | |
| 2007/0017601 | A1 | 1/2007 | Miyata et al. | |
| 2007/0034299 | A1 | 2/2007 | Machida et al. | |
| 2007/0160863 | A1 | 7/2007 | Hamada et al. | |
| 2007/0240787 | A1 | 10/2007 | Nakamura et al. | |
| 2007/0240788 | A1 | 10/2007 | Nakamura et al. | |
| 2007/0240789 | A1 | 10/2007 | Nakamura et al. | |
| 2008/0054736 | A1 | 3/2008 | Miyata et al. | |
| 2008/0223489 | A1 | 9/2008 | Nagata et al. | |
| 2008/0245442 | A1 | 10/2008 | Nakamura et al. | |
| 2008/0247896 | A1 | 10/2008 | Cooper et al. | |
| 2008/0247898 | A1 | 10/2008 | Nakamura et al. | |
| 2009/0020193 | A1 | 1/2009 | Ohta et al. | |
| 2009/0098006 | A1 | 4/2009 | Nakamura et al. | |
| 2009/0226339 | A1 | 9/2009 | Nakamura et al. | |

FOREIGN PATENT DOCUMENTS

| | | | |
|---|---|---|---|
| EP | 0 345 092 | A1 * | 6/1989 |
| EP | 0633581 | A1 | 11/1995 |
| EP | 1267365 | A2 | 12/2002 |
| EP | 1643513 | A1 | 4/2006 |
| EP | 1 705 668 | A2 | 9/2006 |
| EP | 1 705 669 | A2 | 9/2006 |
| EP | 1 705 670 | A2 | 9/2006 |
| EP | 1 705 671 | A2 | 9/2006 |
| EP | 1734539 | A1 | 12/2006 |
| EP | 1746611 | A1 | 1/2007 |
| EP | 1830371 | A1 | 9/2007 |
| JP | 53-001807 | A | 1/1978 |
| JP | 61-195954 | A | 8/1986 |
| JP | 62-192566 | A | 8/1987 |
| JP | 62-256412 | A | 11/1987 |
| JP | 1-117303 | A | 5/1989 |
| JP | 1-155603 | A | 6/1989 |
| JP | 1-251704 | A | 10/1989 |
| JP | 3-188241 | A | 8/1991 |
| JP | 2904571 | B2 | 6/1992 |
| JP | 4-184901 | A | 7/1992 |
| JP | 4-328204 | A | 11/1992 |
| JP | 4-328804 | A | 11/1992 |
| JP | 5-021218 | A | 1/1993 |
| JP | 5-031807 | B2 | 5/1993 |
| JP | 6-158238 | A | 6/1994 |
| JP | 6-244011 | A | 9/1994 |
| JP | 3143156 | B2 | 3/2001 |
| JP | 2002-093610 | A | 3/2002 |
| JP | 2003-282312 | A | 10/2003 |
| JP | 3471876 | B2 | 12/2003 |
| JP | 2004-281-493 | A | 10/2004 |
| JP | 2004-281492 | A | 10/2004 |
| JP | 2004-296973 | A | 10/2004 |
| JP | 2004-304038 | A | 10/2004 |
| JP | 2005-011973 | A | 1/2005 |
| JP | 2005-285861 | A | 10/2005 |
| JP | 2006-049865 | A | 2/2006 |
| JP | 2007-053351 | A | 3/2007 |
| RU | 1 513 738 | A1 | 4/1995 |
| RU | 2 136 068 | C1 | 8/1999 |
| WO | 2004/064085 | A1 | 7/2004 |
| WO | 2004/114333 | A1 | 12/2004 |
| WO | 2005/123974 | A1 | 12/2005 |
| WO | 2006/003882 | A1 | 1/2006 |
| WO | WO 2006/043348 | A1 | 4/2006 |
| WO | 2007/119551 | A1 | 10/2007 |

OTHER PUBLICATIONS

Press Release (Shin-Etsu News) dated on Mar. 24, 2005.

Intermag Asia 2005; Digest of the IEEE International Magnetics Conference; p. 476; held on Apr. 4-8, 2005.

Techno-Frontier Symposium 2005; pp. B1-2-1 to B1-2-12; held on Apr. 20, 2005 by JMA.

IEEE Transactions on Magnetics, vol. 41, No. 10. Oct. 2005, pp. 3844-3846.

Abstract of Autumn Meeting of Japan Society of Powder and Powder Metallurgy, 2005; p. 143; held on Nov. 14-16, 2005.

2005 BM Symposium, Abstract of Presentation by the Japan Association of Bonded Magnet Industries held on Dec. 2, 2005.

Hajime Nakamura, "Nd-Fe-B Sintered Magnets Produced by the Grain Boundary Diffusion Process", Bulletin of Topical Symposium of the Magnetic Society of Japan, Mar. 14, 2006, pp. 13-18.

IEEE International Magnetics Conference, May 8-12, 2006, p. 910.

Digest of the 30$^{th}$ Annual Conference on Magnetics in Japan 2006, pp. 417-418.

European Search Report dated May 28, 2008, issued in corresponding European Patent Application No. 07251607.

"Shin-Etsu Chemical, develops new high-performance technology for neodymium rare-earth magnets", Shin-Etsu News, press release in Tokyo, Mar. 24, 2005.

The Nikkan Kogyo Shimbun, reporting the press release, Mar. 25, 2005.

The Dempa Shimbun, reporting the press release, Mar. 25, 2005.

The Kagaku Kogyo Nippo, reporting the press release, Mar. 25, 2005.

The Sekiyu Kagaku Shimbun Nikkan Tsushin, reporting the press release, Mar. 25, 2005.

The Nikkan Chemical News, reporting the press release, Mar. 25, 2005.

Nikkei Net, reporting the press release, Mar. 25, 2005.

Kenichi Machida et al., "Grain Boundary Modification and Magnetic Properties of Nd-Fe-B Sintered Magnets", Abstracts of Spring Meeting of Japan Society of Powder and Powder Metallurgy, 2004, pp. 202.

Hajime Nakamura, et al., "Microstructures of the anisotropic Nd-Fe-B HDDR treated powder," The Papers of Technical Meeting on Magnetics, Nov. 17, 1998, pp. 31-36, Technical Meeting on Magnetics, The Institute of Electrical Engineers of Japan.

Nakamura, Hajime, "Nd-Fe-B Based Sintered Magnet Processed to Ultraminiature Size", The Journal of the Institute of Electrical Engineers of Japan, Nov. 1, 2004, p. 699-702, vol. 124 No. 11.

K.D. Durst et al., "The Coercive Field of Sintered and Melt-Spun Nd-Fe-B Magnets", Journal of Magnetism and Magnetic Materials, 1987, p. 63-75, vol. 68.

K. T. Park et al., "Effect of Metal-Coating and Consecutive Heat Treatment on Coercivity of Thin Nd-Fe-B Sintered Magnets", Proceedings of the Sixteenth International Workshop on Rare-Earth Magnets and Their Applications, Sendai, 2000, p. 257-264.

Supplemental European Search Report, issued Mar. 22, 2010, for corresponding European Patent Application No. 07740024.0.

International Search Report of PCT/JP2007/056594, date of mailing Jul. 10, 2007.

International Search Report of PCT/JP2007/056586, date of mailing Jun. 19, 2007.

European Search Report dated Jun. 4, 2008, issued in corresponding European Patent Application No. 07251603.2.

European Search Report dated Jun. 26, 2008, issued in corresponding European Patent Application No. 08250927.4.

Qin, C-D et al., "The protective coatings of NdFeB magnets by Al and Al(Fe)", Journal of Applied Physics, Apr. 15, 1996, pp. 4854-4856, vol. 79 No. 8.

Russian Decision on Grant dated Mar. 18, 2009, issued in corresponding Russian patent application No. 2006117529/02.

Extended European Search Report dated Jan. 14, 2008 for European Application No. 06250542.5.

Translation of International Preliminary Report on Patentability mailed May 3, 2007 of International Application No. PCT/JP2005/005134.
International Search Report of PCT/JP2005/005134, Mailing Date of Jul. 12, 2005.
Kim, A. S. et al., "Development of High Coercive Powder From the Nd-Fe-B Sintered Magnet Scrap", IEEE Transactions on Magnetics, Jul. 2004, p. 2877-2879, vol. 40 No. 4, XP-011117004.
Hirota, K. et al., "Coercivity Enhancement by the Grain Boundary Diffusion Process to Nd-Fe-B Sintered Magnets", IEEE Transactions on Magnetics, Oct. 2006, p. 2909-2911, vol. 42 No. 10, XP-002463459.
Extended European Search Report, issued Mar. 31, 2008 for corresponding European Patent Application No. 07254503.1.
Office Action issued Sep. 8, 2010 in corresponding Japanese Patent Application 2006-112327.
Office Action issued Sep. 8, 2010 in corresponding Japanese Patent Application 2006-112342.

* cited by examiner

METHOD FOR PREPARING RARE EARTH PERMANENT MAGNET MATERIAL

CROSS-REFERENCE TO RELATED APPLICATION

This non-provisional application claims priority under 35 U.S.C. §119(a) on Patent Application Nos. 2006-112327 and 2006-112342 filed in Japan on Apr. 14, 2006 and Apr. 14, 2006, respectively, the entire contents of which are hereby incorporated by reference.

TECHNICAL FIELD

This invention relates to a heat resistant R—Fe—B permanent magnet designed to prevent magnetic properties from deterioration by surface machining of sintered magnet body, and more particularly, to a method for preparing a high-performance rare earth permanent magnet material of compact size or reduced thickness having a specific surface area (S/V) of at least 6 $mm^{-1}$.

BACKGROUND ART

By virtue of excellent magnetic properties, R—Fe—B permanent magnets as typified by Nd—Fe—B systems find an ever increasing range of application. For modern electronic equipment having magnets built therein including computer-related equipment, hard disk drives, CD players, DVD players, and mobile phones, there are continuing demands for weight and size reduction, better performance, and energy saving. Under the circumstances, R—Fe—B magnets, and among others, high-performance R—Fe—B sintered magnets must clear the requirements of compact size and reduced thickness. In fact, there is an increasing demand for magnets of compact size or reduced thickness as demonstrated by a magnet body with a specific surface area (S/V) in excess of 6 $mm^{-1}$.

To process an R—Fe—B sintered magnet of compact size or thin type to a practical shape so that it may be mounted in a magnetic circuit, a sintered magnet in compacted and sintered block form must be machined. For the machining purpose, outer blade cutters, inner blade cutters, surface machines, centerless grinding machines, lapping machines and the like are utilized.

However, it is known that when an R—Fe—B sintered magnet is machined by any of the above-described machines, magnetic properties become degraded as the size of a magnet body becomes smaller. This is presumably because the machining deprives the magnet surface of the grain boundary surface structure that is necessary for the magnet to develop a high coercive force. Making investigations on the coercive force in proximity to the surface of R—Fe—B sintered magnets, the inventors found that when the influence of residual strain by machining is minimized by carefully controlling the machining rate, the average thickness of an affected layer on the machined surface becomes approximately equal to the average crystal grain size as determined from the grain size distribution profile against the area fraction. In addition, the inventors proposed a magnet material wherein the crystal grain size is controlled to 5 μm or less during the magnet preparing process in order to mitigate the degradation of magnetic properties (JP-A 2004-281492). In fact, the degradation of magnetic properties can be suppressed to 15% or less even in the case of a minute magnet piece having S/V in excess of 6 $mm^{-1}$. However, the progress of the machining technology has made it possible to produce a magnet body having S/V in excess of 30 $mm^{-1}$, which gives rise to a problem that the degradation of magnetic properties exceeds 15%.

The inventors also found a method for tailoring a sintered magnet body machined to a small size, by melting only the grain boundary phase, and diffusing it over the machined surface for restoring magnetic properties of surface particles (JP-A 2004-281493). The magnet body tailored by this method still has the problem that corrosion resistance is poor when its S/V is in excess of 30 $mm^{-1}$.

Methods for the preparation of R—Fe—B magnet powder for bonded magnets include the hydrogenation-disproportionation-desorption-recombination (HDDR) process. The HDDR process involves heat treating in a hydrogen atmosphere to induce disproportionation reaction on the $R_2Fe_{14}B$ compound as the primary phase for decomposing into $RH_2$, Fe, and $Fe_2B$, and reducing the hydrogen partial pressure for dehydrogenation to induce recombination into the original $R_2Fe_{14}B$ compound. When a magnet powder is prepared by the HDDR process, it consists of crystal grains with a size of about 200 nm which is smaller than the grain size in sintered magnets by one or more order, and particles of degraded properties present at the magnet surface in a magnet powder with a size of 150 μm (S/V=40) account for only 1% by volume at most. Then no noticeable degradation of properties is observable. By controlling the disproportionation and recombination reactions in the HDDR process, grain refinement can be achieved while inheriting the crystal orientation of the original $R_2Fe_{14}B$ grains. Then a so-called anisotropic powder can be prepared. The anisotropic powder has the advantage of very high magnetic properties, as compared with isotropic powder prepared by the melt quenching process. However, bonded magnets prepared therefrom have a maximum energy product of about 17 to 25 MGOe, which value is as low as one-half or less the maximum energy product of sintered magnets.

For R—Fe—B magnets, it is known to add Dy or Tb as part of R to enhance the heat resistance. The intrinsic coercive force is also increased by the addition. However, the HDDR process is not applicable to those alloys containing certain amounts of Dy and Tb because Dy and Tb act to inhibit disproportionation reaction in hydrogen.

It was thus believed difficult in a substantial sense to produce an R—Fe—B ultrafine magnet body having excellent magnetic properties and heat resistance and free of degradation of magnetic properties.

DISCLOSURE OF THE INVENTION

An object of the invention is to provide a method for preparing a rare earth permanent magnet material in the form of an R—Fe—B anisotropic sintered magnet material wherein magnetic properties once degraded by machining are restored.

Regarding a sintered magnet body as machined, the inventors have found that its magnetic properties degraded by machining are restored and its coercive force is increased by subjecting the magnet body, with a powder comprising an oxide of $R^2$, a fluoride of $R^3$ or an oxyfluoride of $R^4$ being disposed on the magnet surface, to heat treatment in a hydrogen atmosphere and subsequent heat treatment in a dehydrogenating atmosphere. Regarding a sintered magnet body as machined, the inventors have also found that its magnetic properties degraded by machining are restored and its coercive force is increased by subjecting the magnet body to disproportionation treatment in a hydrogen atmosphere and heat treatment to induce recombination reaction, disposing a powder comprising an oxide of $R^2$, a fluoride of $R^3$ or an oxyfluoride of $R^4$ on the magnet surface, and subjecting it heat treatment in vacuum or in an inert gas.

In a first aspect, the invention provides a method for preparing a permanent magnet material, comprising the steps of providing an anisotropic sintered magnet body having the compositional formula: $R^1_x(Fe_{1-y}Co_y)_{100-x-z-a}B_zM_a$ wherein $R^1$ is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R^1_2Fe_{14}B$ compound as a primary phase; machining the magnet body to a specific surface area of at least 6 $mm^{-1}$; disposing on a surface of the machined magnet body a powder comprising at least one of an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and having an average particle size equal to or less than 100 μm; heat treating the machined magnet body having the powder disposed on its surface in a hydrogen gas-containing atmosphere at 600 to 1,100° C. for inducing disproportionation reaction on the $R^1_2Fe_{14}B$ compound; and continuing heat treatment in an atmosphere having a reduced hydrogen gas partial pressure at 600 to 1,100° C. for inducing recombination reaction to the $R^1_2Fe_{14}B$ compound, thereby finely dividing the $R^1_2Fe_{14}B$ compound phase to a crystal grain size equal to or less than 1 μm, and for effecting absorption treatment, thereby causing at least one of $R^2$, $R^3$, and $R^4$ in the powder to be absorbed in the magnet body.

In a second aspect, the invention provides a method for preparing a permanent magnet material, comprising the steps of providing an anisotropic sintered magnet body having the compositional formula: $R^1_x(Fe_{1-y}Co_y)_{100-x-z-a}B_zM_a$ wherein $R^1$ is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R^1_2Fe_{14}B$ compound as a primary phase; machining the magnet body to a specific surface area of at least 6 $mm^{-1}$; heat treating the magnet body in a hydrogen gas-containing atmosphere at 600 to 1,100° C. for inducing disproportionation reaction on the $R^1_2Fe_{14}B$ compound; continuing heat treatment in an atmosphere having a reduced hydrogen gas partial pressure at 600 to 1,100° C. for inducing recombination reaction to the $R^1_2Fe_{14}B$ compound, thereby finely dividing the $R^1_2Fe_{14}B$ compound phase to a crystal grain size equal to or less than 1 μm; disposing on a surface of the magnet body a powder comprising at least one of an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and having an average particle size equal to or less than 100 μm; heat treating the magnet body having the powder disposed on its surface at a temperature equal to or below the temperature of said heat treatment in an atmosphere having a reduced hydrogen gas partial pressure, in vacuum or in an inert gas, for absorption treatment, thereby causing at least one of $R^2$, $R^3$, and $R^4$ in the powder to be absorbed in the magnet body.

Preferred embodiments of the first and second aspects include the following.

(i) The powder is disposed on the magnet body surface in an amount corresponding to an average filling factor of at least 10% by volume in a magnet body-surrounding space at a distance equal to or less than 1 mm from the magnet body surface.

(ii) In the powder comprising at least one of an oxide of $R^2$, a fluoride of $R^3$, and an oxyfluoride of $R^4$, $R^2$, $R^3$, or $R^4$ contains at least 10 atom % of Dy and/or Tb, and the total concentration of Nd and Pr in $R^2$, $R^3$ or $R^4$ is lower than the total concentration of Nd and Pr in $R^1$.

(iii) The powder comprises at least 40% by weight of the fluoride of $R^3$ and/or the oxyfluoride of $R^4$, with the balance containing at least one member selected from the group consisting of the oxide of $R^2$ and a carbide, nitride, oxide, hydroxide, and hydride of $R^5$ wherein $R^5$ is at least one element selected from rare earth elements inclusive of Sc and Y.

(iv) The powder comprises the fluoride of $R^3$ and/or the oxyfluoride of $R^4$, and the absorption treatment causes fluorine contained in the powder to be absorbed in the magnet body.

In further preferred embodiments, the method for preparing a permanent magnet material according to the first aspect may include the following steps alone or in combination.

(v) The step of washing the machined magnet body with at least one agent selected from alkalis, acids, and organic solvents prior to the disposing step.

(vi) The step of shot blasting the machined magnet body for removing a surface affected layer prior to the disposing step.

(vii) The step of washing the machined magnet body with at least one agent selected from alkalis, acids, and organic solvents after the heat treatment.

(viii) The step of machining the magnet body after the heat treatment.

(ix) The step of plating or coating the magnet body, after the heat treatment, after the alkali, acid or organic solvent washing step following the heat treatment, or after the machining step following the heat treatment.

In further preferred embodiments, the method for preparing a permanent magnet material according to the second aspect may include the following steps alone or in combination.

(x) The step of washing the machined magnet body with at least one agent selected from alkalis, acids, and organic solvents prior to the disproportionation reaction treatment.

(xi) The step of shot blasting the machined magnet body for removing a surface affected layer prior to the disproportionation reaction treatment.

(xii) The step of washing the machined magnet body with at least one agent selected from alkalis, acids, and organic solvents after the absorption treatment.

(xiii) The step of machining the magnet body after the absorption treatment.

(xiv) The step of plating or coating the magnet body, after the absorption treatment, after the alkali, acid or organic solvent washing step following the absorption treatment, or after the machining step following the absorption treatment.

BENEFITS OF THE INVENTION

According to the invention, permanent magnets of a compact size or thin plate corresponding to S/V of at least 6 $mm^{-1}$ exhibiting excellent magnetic properties and heat resistance are obtained because their magnetic properties once degraded by machining are restored.

BRIEF DESCRIPTION OF THE DRAWING

The only FIGURE.

DESCRIPTION OF THE PREFERRED EMBODIMENTS

Figure 1:
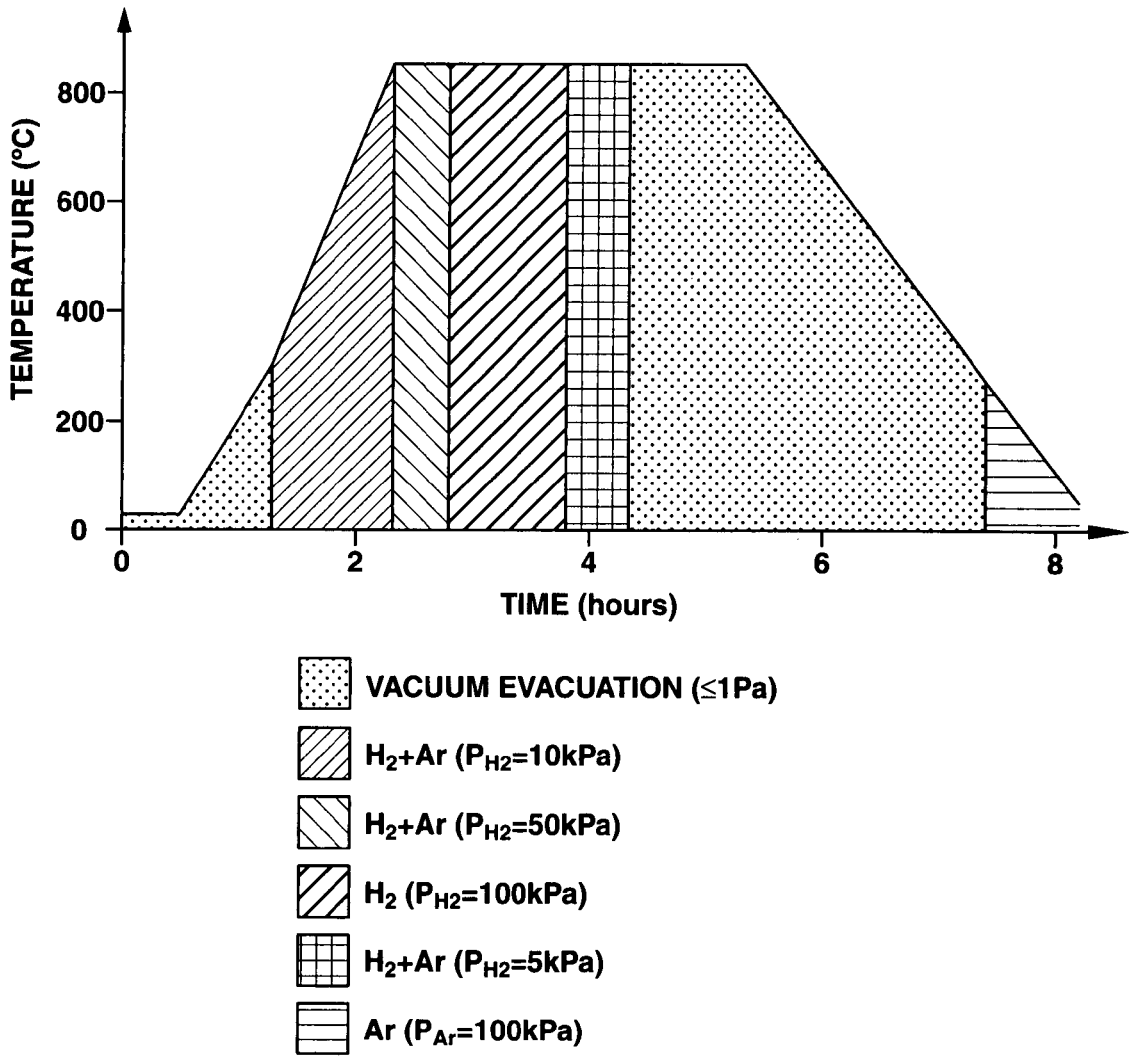
FIG. 1 is a diagram showing the heat treatment schedule in Examples.

The invention is directed to a method for preparing a heat resistant rare earth permanent magnet material of compact size or reduced thickness having a specific surface area S/V of at least 6 $mm^{-1}$ from an R—Fe—B sintered magnet body so as to prevent magnetic properties from being degraded by machining of the magnet body surface.

The invention starts with an $R^1$—Fe—B sintered magnet body which is obtainable from a mother alloy by a standard procedure including crushing, fine pulverization, compaction and sintering.

As used herein, R and $R^1$ are selected from rare earth elements inclusive of Sc and Y. R is mainly used for the finished magnet body while $R^1$ is mainly used for the starting material.

The mother alloy contains $R^1$, iron (Fe), and boron (B). $R^1$ is at least one element selected from rare earth elements inclusive of Sc and Y, specifically from among Sc, Y, La, Ce, Pr, Nd, Sm, Eu, Gd, Tb, Dy, Ho, Er, Yb, and Lu, with Nd and Pr being preferably predominant. It is preferred that rare earth elements inclusive of Sc and Y account for 10 to 15 atom %, more preferably 11.5 to 15 atom % of the overall alloy. Desirably R contains at least 10 atom %, especially at least 50 atom % of Nd and/or Pr. It is preferred that boron (B) account for 3 to 15 atom %, more preferably 5 to 8 atom % of the overall alloy. The alloy may further contain one or more elements selected from Al, Cu, Zn, In, Si, P, S, Ti, V, Cr, Mn, Ni, Ga, Ge, Zr, Nb, Mo, Pd, Ag, Cd, Sn, Sb, Hf, Ta, and W, in an amount of 0 to 11 atom %, especially 0.1 to 4 atom %. The balance consists of iron (Fe) and incidental impurities such as C, N, and O. The content of Fe is preferably at least 50 atom %, especially at least 65 atom %. It is acceptable that part of Fe, specifically 0 to 40 atom %, more specifically 0 to 20 atom % of Fe be replaced by cobalt (Co).

The mother alloy is prepared by melting metal or alloy feeds in vacuum or an inert gas atmosphere, preferably argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since α-Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, a so-called melt quenching technique is applicable as well as the above-described casting technique.

The crushing step uses a Brown mill or hydriding pulverization, with the hydriding pulverization being preferred for those alloys as strip cast. The coarse powder is then finely divided by a jet mill using nitrogen under pressure. The fine powder is compacted on a compression molding machine while being oriented under a magnetic field. The green compact is placed in a sintering furnace where it is sintered in vacuum or in an inert gas atmosphere usually at a temperature of 900 to 1,250° C., preferably 1,000 to 1,100° C.

In this way, a sintered magnet body or sintered block is obtained. It is an anisotropic sintered magnet body having the compositional formula:

$$R^1_x(Fe_{1-y}Co_y)_{100-x-z-a}B_zM_a$$

wherein $R^1$ is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$. Notably the magnet body contains a $R^1_2Fe_{14}B$ compound as a primary phase.

The sintered body or block is then machined into a practical shape. The machining may be carried out by a standard technique. To minimize the influence of residual strain by machining, the machining speed is preferably set as low as possible within the range not detracting from productivity. Specifically, the machining speed is 0.1 to 20 mm/min, more preferably 0.5 to 10 mm/min.

The volume of material removed is such that the resultant sintered block has a specific surface area S/V (surface area $mm^2$/volume $mm^3$) of at least 6 $mm^{-1}$, preferably at least 8 $mm^{-1}$. Although the upper limit is not particularly limited and may be selected as appropriate, it is generally up to 45 $mm^{-1}$, especially up to 40 $mm^{-1}$.

If an aqueous coolant is fed to the machining tool or if the machined surface is exposed to elevated temperature during machining, there is a likelihood that an oxide layer form on the machined surface, which oxide layer can prevent absorption and release of hydrogen at the magnet body surface. In this case, the magnet body is washed with at least one of alkalis, acids, and organic solvents or shot blasted for removing the oxide layer, rendering the magnet body ready for heat treatment in hydrogen.

Suitable alkalis which can be used herein include potassium pyrophosphate, sodium pyrophosphate, potassium citrate, sodium citrate, potassium acetate, sodium acetate, potassium oxalate, sodium oxalate, etc.; suitable acids include hydrochloric acid, nitric acid, sulfuric acid, acetic acid, citric acid, tartaric acid, etc.; and suitable organic solvents include acetone, methanol, ethanol, isopropyl alcohol, etc. In the washing step, the alkali or acid may be used as an aqueous solution with a suitable concentration not attacking the magnet body.

In the first aspect, after the sintered magnet body is machined to a specific surface area S/V of at least 6 $mm^{-1}$, a powder is disposed on a surface of the machined magnet body. The powder comprises at least one of an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and has an average particle size equal to or less than 100 μm.

Notably, illustrative examples of $R^2$, $R^3$, and $R^4$ are the same as $R^1$ while $R^2$, $R^3$, and $R^4$ may be identical with or different from $R^1$. In the powder comprising at least one of an oxide of $R^2$, a fluoride of $R^3$, and an oxyfluoride of $R^4$, it is preferred for the objects of the invention that each of $R^3$, $R^4$, and $R^5$ contain at least 10 atom %, more preferably at least 20 atom %, even more preferably 40 to 100 atom % of Dy and/or Tb, and the total concentration of Nd and Pr in $R^2$, $R^3$ or $R^4$ be lower than the total concentration of Nd and Pr in $R^1$.

In the powder comprising at least one of an oxide of $R^2$, a fluoride of $R^3$, and an oxyfluoride of $R^4$, it is preferred for effective absorption of R that the powder comprise at least 40% by weight of the fluoride of $R^3$ and/or the oxyfluoride of $R^4$, with the balance containing at least one member selected from the group consisting of the oxide of $R^2$ and a carbide, nitride, oxide, hydroxide, and hydride of $R^5$ wherein $R^5$ is at least one element selected from rare earth elements inclusive of Sc and Y.

The oxide of $R^2$, fluoride of $R^3$, and oxyfluoride of $R^4$ used herein are typically $R^2{}_2O_3$, $R^3F_3$, and $R^4OF$, respectively. They generally refer to oxides containing $R^2$ and oxygen, fluorides containing $R^3$ and fluorine, and oxyfluorides containing $R^4$, oxygen and fluorine, including $R^2O_n$, $R^3F_n$, and $R^4O_mF_n$ wherein m and n are arbitrary positive numbers, and modified forms in which part of $R^2$, $R^3$ or $R^4$ is substituted or stabilized with another metal element as long as they can achieve the benefits of the invention.

The powder to be disposed on the magnet surface contains the oxide of $R^2$, fluoride of $R^3$, oxyfluoride of $R^4$ or a mixture thereof and optionally, at least one member selected from among hydroxides, carbides and nitrides of $R^2$ to $R^4$ or a mixture or composite thereof.

Further, the powder may contain a fine powder of boron, boron nitride, silicon, carbon or the like, or an organic compound such as stearic acid in order to promote the dispersion or chemical/physical adsorption of the powder particles. In order for the invention to attain its effect efficiently, the powder preferably contains the oxide of $R^2$, fluoride of $R^3$, oxyfluoride of $R^4$ or a mixture thereof in a proportion of at least 40% by weight, preferably at least 60% by weight, more preferably at least 80% by weight and even 100% by weight based on the total weight of the powder.

According to the invention, the treatment to be described below causes one or more elements selected from $R^2$, $R^3$ and $R^4$ to be absorbed in the magnet body. For the reason that a more amount of $R^2$, $R^3$ or $R^4$ is absorbed as the filling factor of the powder in the magnet surface-surrounding space is higher, the filling factor should preferably be at least 10% by volume, more preferably at least 40% by volume, calculated as an average value in the magnet surrounding space from the magnet surface to a distance equal to or less than 1 mm. The upper limit of filling factor is generally equal to or less than 95% by volume, and especially equal to or less than 90% by volume, though not particularly restrictive.

One exemplary technique of disposing or applying the powder is by dispersing a fine powder comprising one or more members selected from an oxide of $R^2$, a fluoride of $R^3$, and an oxyfluoride of $R^4$ in water or an organic solvent to form a slurry, immersing the magnet body in the slurry, and drying in hot air or in vacuum or drying in the ambient air. Alternatively, the powder can be applied by spray coating or the like. Any such technique is characterized by ease of application and mass treatment. Specifically the slurry contains the powder in a concentration of 1 to 90% by weight, more specifically 5 to 70% by weight.

The particle size of the fine powder affects the reactivity when the $R^2$, $R^3$ or $R^4$ component in the powder is absorbed in the magnet. Smaller particles offer a larger contact area that participates in the reaction. In order for the invention to attain its effect, the powder disposed around the magnet should desirably have an average particle size equal to or less than 100 μm, preferably equal to or less than 10 μm. The lower limit of particle size is preferably equal to or more than 1 nm, more preferably equal to or more than 10 nm though not particularly restrictive. It is noted that the average particle size is determined as a weight average diameter $D_{50}$ (particle diameter at 50% by weight cumulative, or median diameter) upon measurement of particle size distribution by laser diffractometry.

After the powder comprising an oxide of $R^2$, a fluoride of $R^3$, an oxyfluoride of $R^4$ or a mixture thereof is disposed on the magnet body surface, HDDR treatment is carried out according to the schedule described below. The machined magnet body having the powder disposed on its surface is heat treated in a hydrogen gas-containing atmosphere at a temperature of 600 to 1,100° C. for inducing disproportionation reaction on the primary phase $R^1{}_2Fe_{14}B$ compound, and subsequently heat treated in an atmosphere having a reduced hydrogen gas partial pressure at a temperature of 600 to 1,100° C. for inducing recombination reaction to the $R^1{}_2Fe_{14}B$ compound, thereby finely dividing the $R^1{}_2Fe_{14}B$ compound phase to a crystal grain size equal to or less than 1 μm, and for effecting absorption treatment, thereby causing at least one of $R^2$, $R^3$, and $R^4$ contained in the powder to be absorbed in the magnet body.

These treatments are described in more detail. For the disproportionation reaction treatment, generally the magnet body is placed into a furnace, after which heating is started. The atmosphere is preferably a vacuum or an inert gas such as argon while heating from room temperature to 300° C. If the atmosphere contains hydrogen in this temperature range, hydrogen atoms can be incorporated between lattices of $R^1{}_2Fe_{14}B$ compound, whereby the magnet body be expanded in volume and hence broken. Over the range from 300° C. to the treatment temperature (600 to 1,100° C., preferably 700 to 1,000° C.), heating is preferably continued in an atmosphere having a hydrogen partial pressure equal to or less than 100 kPa although the hydrogen partial pressure depends on the composition of the magnet body and the heating rate. The heating rate is preferably 1 to 20° C./min. The pressure is limited for the following reason. If heating is effected at a hydrogen partial pressure in excess of 100 kPa, the decomposition reaction of $R^1{}_2Fe_{14}B$ compound commences in the heating step (at 600 to 700° C., though dependent on the magnet composition), so that the decomposed structure may grow into a coarse globular shape in the course of heating, which can preclude the structure from becoming anisotropic by recombination into $R^1{}_2Fe_{14}B$ compound during the subsequent dehydrogenation treatment. Once the treatment temperature is reached, the hydrogen partial pressure is increased to 100 kPa or above (though dependent on the magnet composition). Under these conditions, the magnet body is held preferably for 10 minutes to 10 hours, more preferably 20 minutes to 8 hours, even more preferably 30 minutes to 5 hours, for inducing disproportionation reaction on the $R^1{}_2Fe_{14}B$ compound. Through this disproportionation reaction, the $R^1{}_2Fe_{14}B$ compound is decomposed into $R^1H_2$, Fe, and $Fe_2B$. The holding time is limited for the following reason. If the treating time is less than 10 minutes, disproportionation reaction may not fully proceed, and unreacted $R^1{}_2Fe_{14}B$ compound be left in addition to the decomposed products: $R^1H_2$, α-Fe, and $Fe_2B$. If heat treatment continues over a longer period, magnetic properties can be deteriorated by inevitable oxidation. For these reasons, the holding time is not less than 10 minutes and not more than 10 hours. More preferably the holding time is 30 minutes to 5 hours. It is preferred to increase the hydrogen partial pressure stepwise during the isothermal treatment. If the hydrogen partial pressure is increased at a stroke, acute reaction occurs so that the decomposed structure becomes non-uniform. This can lead to non-uniform crystal grain size upon recombination into $R^1{}_2Fe_{14}B$ compound during the subsequent dehydrogenation treatment, resulting in a decline of coercivity or squareness.

The hydrogen partial pressure is equal to or more than 100 kPa as described above, preferably 100 to 200 kPa, and more preferably 150 to 200 kPa. The hydrogen partial pressure is increased stepwise to the ultimate value. In an example wherein the hydrogen partial pressure is kept at 20 kPa during the heating step and increased to an ultimate value of 100 kPa, the hydrogen partial pressure is increased stepwise according to such a schedule that the hydrogen partial pressure is set at 50 kPa in a period from the point when the holding temperature is reached to an initial 30% duration of the holding time.

The disproportionation reaction treatment is followed by the recombination reaction treatment. The treating temperature is the same as in the disproportionation reaction treatment. The treating time is preferably 10 minutes to 10 hours, more preferably 20 minutes to 8 hours, even more preferably 30 minutes to 5 hours. The recombination reaction is performed in an atmosphere having a reduced hydrogen partial pressure, preferably a hydrogen partial pressure of 1 kPa to $10^{-5}$ Pa, more preferably 10 Pa to $10^{-4}$ Pa, though the exact hydrogen partial pressure is dependent on the alloy composition.

After the recombination reaction treatment, the magnet body may be cooled at a rate of about −1 to −20° C./min to room temperature.

In the second aspect of the invention, once the anisotropic sintered magnet body is machined to a specific surface area of at least 6 $mm^{-1}$, the machined magnet body is subjected to HDDR treatment wherein the magnet body is heat treated in hydrogen and then to absorption treatment wherein the magnet body is heat treated while a powder comprising an oxide of $R^2$, a fluoride of $R^3$, an oxyfluoride of $R^4$ or a mixture thereof (wherein $R^2$, $R^3$, and $R^4$ are selected from rare earth elements inclusive of Sc and Y) and having an average particle size equal to or less than 100 μm is disposed on the magnet body surface.

The HDDR treatment is as described above. First disproportionation reaction treatment is performed, and recombination reaction treatment is then performed.

In the subsequent absorption treatment, the type and amount of the powder used and the powder applying technique are as described above. When the magnet body with a powder comprising at least one of an oxide of $R^2$, a fluoride of $R^3$, and an oxyfluoride of $R^4$ being disposed on its surface is heat treated in vacuum or in an inert gas atmosphere (e.g., Ar or He) at a temperature equal to or below the sintering temperature of the magnet body—absorption treatment—, the heat treatment temperature (absorption treatment temperature) should be equal to or lower than the temperature of the recombination reaction treatment wherein hydrogen is released in an atmosphere having reduced hydrogen pressure.

The absorption treatment temperature is limited for the following reason. If treatment is done at a temperature above the dehydrogenating heat treatment temperature (designated $T_{DR}$ in ° C.), there arise problems like (1) crystal grains grow, failing to provide excellent magnetic properties; (2) the sintered magnet fails to maintain its dimensions as worked due to thermal deformation; and (3) the diffusing R ($R^2$ to $R^4$) can diffuse into the interior of magnet grains beyond the grain boundaries in the magnet, resulting in a reduced remanence. The treatment temperature should thus be equal to or below $T_{DR}$° C., and preferably equal to or below ($T_{DR}$−10)° C. The lower limit of temperature may be selected appropriate and is preferably at least 260° C., more preferably at least 310° C.

The time of absorption treatment is from 1 minute to 10 hours. The absorption treatment is not completed within less than 1 minutes whereas more than 10 hours of treatment gives rise to the problems that the sintered magnet alters its structure and the inevitable oxidation and evaporation of components adversely affect the magnetic properties. The more preferred time is 5 minutes to 8 hours, especially 10 minutes to 6 hours.

By the absorption treatment, R contained in the powder on the magnet surface is diffused and concentrated at grain boundaries in the magnet body so that R substitutes in a sub-surface layer of primary phase $R^1{}_2Fe_{14}B$ compound grains, mainly in a region having a depth equal to or less than about 1 μm. When the powder contains fluorine, part of the fluorine is absorbed in the magnet together with R, drastically enhancing the supply of R from the powder and the diffusion of R at grain boundaries in the magnet. The rare earth element contained in the R oxide, R fluoride, and R oxyfluoride is one or more elements selected from rare earth elements inclusive of Sc and Y. Since the elements which are most effective in enhancing magneto-crystalline anisotropy when concentrated in the sub-surface layer are dysprosium and terbium, it is preferred that the rare earth element contained in the powder contain Dy and/or Tb in a proportion of at least 10 atom %, more preferably at least 20 atom %. Further preferably the proportion of Dy and/or Tb is at least 50 atom %, and even 100 atom %. As a result of the absorption treatment, the coercive force of R—Fe—B sintered magnet in which crystal grains have been finely divided by heat treatment in hydrogen is effectively increased.

In the absorption treatment, the magnets are placed in a container and covered with the powder so that the magnets are kept apart, preventing the magnets from being fused together after the absorption treatment albeit high temperature. Additionally, the powder is not bonded to the magnets after the heat treatment. This permits a number of magnets to be placed in a container for treatment therein, indicating that the preparation method of the invention is also improved in productivity.

After the absorption treatment, the magnet bodies may be washed with water or organic solvent for removing the powder deposit on the magnet body surface, if necessary.

It is noted that before the powder is disposed on the magnet body surface in the first embodiment, or prior to the disproportionation reaction treatment in the second embodiment, the magnet body as machined to the predetermined shape may be washed with at least one agent selected from alkalis, acids and organic solvents or shot blasted for removing a sub-surface layer from the machined magnet.

After the heat treatment in the first embodiment or after the absorption treatment in the second embodiment, the machined magnet may be washed with at least one agent selected from alkalis, acids and organic solvents or machined again. Alternatively, plating or paint coating may be carried out after the absorption treatment, after the washing step, or after the second machining step.

The alkalis, acids and organic solvents used in the washing step are as described above. The above-described washing, shot blasting, machining, plating, and coating steps may be carried out by standard techniques.

The compact size or thin plate permanent magnets of the invention have high heat resistance and are free of degradation of magnetic properties.

EXAMPLE

Examples and Comparative Examples are given below for further illustrating the invention although the invention is not limited thereto. In Examples, the filling factor of powder (such as dysprosium fluoride) in the magnet surface-surrounding space is calculated from a dimensional change and weight gain of the magnet after powder deposition and the true density of powder material.

The average crystal grain size of a sintered magnet body is determined by cutting a sample from a sintered block, mirror polishing a surface of the sample parallel to the oriented direction, dipping the sample in a nitric acid/hydrochloric acid/glycerin liquid at room temperature for 3 minutes for etching, and taking a photomicrograph of the sample under an optical microscope, followed by image analysis. The image analysis includes measuring the areas of 500 to 2,500 crystal grains, calculating the diameters of equivalent circles, plotting them on a histogram with area fraction on the ordinate, and calculating an average value. The average crystal grain size of a magnet body as HDDR treated according to the invention is determined by observing a fracture surface of the magnet under a scanning electron microscope and analyzing a secondary electron image. A linear intercept technique is used for the image analysis.

Example 1 and Comparative Example 1

An alloy in thin plate form was prepared by using Nd, Fe, Co, and Al metals of at least 99 wt % purity and ferroboron, weighing predetermined amounts of them, high-frequency melting them in an Ar atmosphere, and casting the melt onto a single chill roll of copper (strip casting technique). The alloy consisted of 12.5 atom % Nd, 1.0 atom % Co, 1.0 atom % Al, 5.9 atom % B, and the balance of Fe. It is designated alloy A. The alloy A was machined into a coarse powder of under 30 mesh by the so-called hydride pulverization technique including hydriding the alloy and heating up to 500° C. for partial dehydriding while evacuating the chamber to vacuum.

Separately, an alloy was prepared by using Nd, Dy, Fe, Co, Al, and Cu metals of at least 99 wt % purity and ferroboron, weighing predetermined amounts of them, high-frequency melting them in an Ar atmosphere, and casting the melt in a mold. The alloy consisted of 20 atom % Nd, 10 atom % Dy, 24 atom % Fe, 6 atom % B, 1 atom % Al, 2 atom % Cu, and the balance of Co. It is designated alloy B. The alloy B was crushed to a size of under 30 mesh in a nitrogen atmosphere on a Brown mill.

Subsequently, the powders of alloys A and B were weighed in an amount of 90 wt % and 10 wt % and mixed for 30 minutes on a nitrogen-blanketed V blender. On a jet mill using nitrogen gas under pressure, the powder mixture was finely divided into a powder with a mass base median diameter of 4 μm. The fine powder was oriented in a magnetic field of 15 kOe under a nitrogen atmosphere and compacted under a pressure of about 1 ton/cm$^2$. The green compact was then placed in a sintering furnace with an Ar atmosphere where it was sintered at 1,060° C. for 2 hours, obtaining a sintered block of 10 mm×20 mm×15 mm thick. The sintered block had an average crystal grain size of 5.1 μm.

Using an inner blade cutter, the sintered block was machined on all the surfaces into a rectangular parallelepiped body of the predetermined dimensions having a specific surface area S/V of 22 mm$^{-1}$. The sintered body as machined was successively washed with alkaline solution, deionized water, acid and deionized water, and dried.

Subsequently, dysprosium fluoride having an average particle size of 5 μm was mixed with ethanol at a weight fraction of 50%, in which the magnet body was immersed for one minute with ultrasonic waves being applied. The magnet body was pulled up and immediately dried with hot air. At this point, the dysprosium fluoride powder occupied a space spaced from the magnet surface at an average distance of 13 μm, and the filling factor of dysprosium fluoride in the magnet surface-surrounding space was 45% by volume.

The sintered magnet body under powder coverage was subjected to HDDR treatment (disproportionation reaction treatment and recombination reaction treatment) according to the schedule schematically shown in FIG. 1, ultrasonically washed with ethyl alcohol, and dried, yielding a magnet body within the scope of the invention. It is designated magnet body M1 and had an average crystal grain size of 0.25 μm.

For comparison purposes, the sintered magnet body without powder coverage was subjected to HDDR treatment, yielding a magnet body P1.

Magnet bodies M1 and P1 were measured for magnetic properties, which are shown in Table 1. The treatment procedure of the invention contributes to an increase of coercive force $H_{cJ}$ of 400 kAm$^{-}$.

Example 2 and Comparative Example 2

Using the same composition and procedure as in Example 1, a sintered block of 10 mm×20 mm×15 mm thick was prepared. Using an inner blade cutter, the sintered block was machined into a rectangular parallelepiped body of the predetermined dimensions having a specific surface area S/V of 24 mm$^{-1}$. The sintered body as machined was successively washed with alkaline solution, deionized water, acid and deionized water, and dried.

Subsequently, dysprosium oxide having an average particle size of 1 μm, dysprosium fluoride having an average particle size of 5 μm and ethanol were mixed in a weight fraction of 25%, 25% and 50%, in which the magnet body was immersed for one minute with ultrasonic waves being applied. The magnet body was pulled up and immediately dried with hot air. At this point, the dysprosium oxide and dysprosium fluoride occupied a space spaced from the magnet surface at an average distance of 16 μm, and the filling factor was 50% by volume.

The sintered magnet body under powder coverage was subjected to HDDR treatment according to the schedule schematically shown in FIG. 1, ultrasonically washed with ethyl alcohol, and dried, yielding a magnet body within the scope of the invention. It is designated magnet body M2 and had an average crystal grain size of 0.23 μm.

For comparison purposes, the sintered magnet body without powder coverage was subjected to HDDR treatment, yielding a magnet body P2.

Magnet bodies M2 and P2 were measured for magnetic properties, which are shown in Table 1. The treatment procedure of the invention contributes to an increase of coercive force $H_{cJ}$ of 350 kAm$^{-1}$.

Example 3 and Comparative Example 3

An alloy in thin plate form was prepared by using Nd, Co, Al, Fe, and Cu metals of at least 99 wt % purity and ferroboron, weighing predetermined amounts of them, high-frequency melting them in an Ar atmosphere, and casting the melt onto a single chill roll of copper (strip casting technique). The alloy consisted of 14.5 atom % Nd, 1.0 atom % Co, 0.5 atom % Al, 0.2 atom % of Cu, 5.9 atom % B, and the balance of Fe. The alloy was machined into a coarse powder of under 30 mesh by the so-called hydride pulverization technique including hydriding the alloy and heating up to 500° C. for partial dehydriding while evacuating the chamber to vacuum.

On a jet mill using nitrogen gas under pressure, the coarse powder was finely divided into a powder with a mass base median diameter of 4 μm. The fine powder was oriented in a magnetic field of 15 kOe under a nitrogen atmosphere and compacted under a pressure of about 1 ton/cm$^2$. The green compact was then placed in a sintering furnace with an Ar atmosphere where it was sintered at 1,060° C. for 2 hours, obtaining a sintered block of 10 mm×20 mm×15 mm thick. The sintered block had an average crystal grain size of 4.8 μm.

Using an inner blade cutter, the sintered block was machined into a rectangular parallelepiped body of the predetermined dimensions having a specific surface area S/V of 36 $mm^{-1}$. The sintered body as machined was successively washed with alkaline solution, deionized water, acid and deionized water, and dried.

Subsequently, terbium fluoride having an average particle size of 5 μm was mixed with ethanol in a weight fraction of 50%, in which the magnet body was immersed for one minute with ultrasonic waves being applied. The magnet body was pulled up and immediately dried with hot air. At this point, the terbium fluoride occupied a space spaced from the magnet surface at an average distance of 10 μm, and the filling factor was 45% by volume.

The sintered magnet body under powder coverage was subjected to HDDR treatment according to the schedule schematically shown in FIG. 1, ultrasonically washed with ethyl alcohol, and dried, yielding a magnet body within the scope of the invention. It is designated magnet body M3 and had an average crystal grain size of 0.24 μm.

For comparison purposes, the sintered magnet body without powder coverage was subjected to HDDR treatment, yielding a magnet body P3.

Magnet bodies M3 and P3 were measured for magnetic properties, which are shown in Table 1. The treatment procedure of the invention contributes to an increase of coercive force $H_{cJ}$ of 700 $kAm^{-1}$.

Example 4

The magnet body M3 in Example 3 was successively washed with alkaline solution, deionized water, acid and deionized water, and dried. It is designated magnet body M4.

Magnetic properties of magnet body M4 are shown in Table 1. It is seen that the magnet body exhibits high magnetic properties even when the HDDR treatment is followed by the washing step.

Examples 5 and 6

Using the same composition and procedure as in Example 3, a sintered block of 10 mm×20 mm×15 mm thick was prepared. Using an outer blade cutter, the sintered block was machined into a rectangular parallelepiped body of the predetermined dimensions having a specific surface area S/V of 6 $mm^{-1}$. The sintered body as machined was successively washed with alkaline solution, deionized water, acid and deionized water, and dried.

Subsequently, terbium fluoride having an average particle size of 5 μm was mixed with ethanol at a weight fraction of 50%, in which the magnet body was immersed for one minute with ultrasonic waves being applied. The magnet body was pulled up and immediately dried with hot air. At this point, the terbium fluoride powder occupied a space spaced from the magnet surface at an average distance of 13 μm, and the filling factor was 45% by volume.

The sintered magnet body under powder coverage was subjected to HDDR treatment according to the schedule schematically shown in FIG. 1, ultrasonically washed with ethyl alcohol, and dried. Using an inner blade cutter, the magnet body was machined into a rectangular parallelepiped body of the predetermined dimensions having a specific surface area S/V of 36 $mm^{-1}$. The resulting magnet body within the scope of the invention, designated magnet body M5, had an average crystal grain size of 0.28 μm.

The magnet body was subjected to electroless copper/nickel plating, obtaining a magnet body M6 within the scope of the invention.

Magnet bodies M5 and M6 were measured for magnetic properties, which are shown in Table 1. The magnet bodies which were machined and further plated after the HDDR treatment exhibited equivalent magnetic properties to magnet body M3 which was machined to an ultra-compact shape having a specific surface area S/V of 36 $mm^{-1}$ in advance of the HDDR treatment.

TABLE 1

| | Designation | $B_r$ [T] | $H_{cJ}$ [$kAm^{-1}$] | $(BH)_{max}$ [$kJ/m^{-3}$] |
|---|---|---|---|---|
| Example 1 | M1 | 1.34 | 1280 | 345 |
| Example 2 | M2 | 1.34 | 1230 | 340 |
| Example 3 | M3 | 1.38 | 1510 | 370 |
| Example 4 | M4 | 1.38 | 1510 | 370 |
| Example 5 | M5 | 1.37 | 1500 | 365 |
| Example 6 | M6 | 1.37 | 1500 | 365 |
| Comparative Example 1 | P1 | 1.34 | 880 | 345 |
| Comparative Example 2 | P2 | 1.34 | 880 | 340 |
| Comparative Example 3 | P3 | 1.38 | 810 | 370 |

Example 7 and Comparative Example 4

As in Example 1, a sintered block of 10 mm×20 mm×15 mm thick was prepared. The sintered block had an average crystal grain size of 5.2 μm. Using an inner blade cutter, the sintered block was machined on all the surfaces into a rectangular parallelepiped body of the predetermined dimensions having a specific surface area S/V of 22 $mm^{-1}$. The sintered body as machined was successively washed with alkaline solution, deionized water, acid and deionized water, and dried.

The sintered magnet body was subjected to HDDR treatment (disproportionation reaction treatment and recombination reaction treatment) according to the schedule schematically shown in FIG. 1. It was ultrasonically washed with ethyl alcohol, and dried, yielding a magnet body P4.

Subsequently, dysprosium fluoride having an average particle size of 5 μm was mixed with ethanol at a weight fraction of 50%, in which the magnet body was immersed for one minute with ultrasonic waves being applied. The magnet body was pulled up and immediately dried with hot air. At this point, the dysprosium fluoride powder occupied a space spaced from the magnet surface at an average distance of 15 μm, and the filling factor was 45% by volume. The magnet body under powder coverage was subjected to absorption treatment by heating at 840° C. for one hour in an Ar atmosphere. It was ultrasonically washed with ethanol and dried, yielding a magnet body, designated magnet body M7, having an average crystal grain size of 0.45 μm.

Magnet bodies M7 and P4 were measured for magnetic properties, which are shown in Table 2. The treatment procedure of the invention contributes to an increase of coercive force $H_{cJ}$ of 350 $kAm^{-1}$.

Example 8 and Comparative Example 5

As in Example 1, a sintered block of 10 mm×20 mm×15 mm thick was prepared. Using an inner blade cutter, the sintered block was machined on all the surfaces into a rectangular parallelepiped body of the predetermined dimensions having a specific surface area S/V of 24 $mm^{-1}$. The sintered body as machined was successively washed with alkaline solution, deionized water, acid and deionized water, and dried.

The sintered magnet body was subjected to HDDR treatment according to the schedule schematically shown in FIG. 1. It was ultrasonically washed with ethyl alcohol, and dried, yielding a magnet body P5.

Subsequently, dysprosium oxide having an average particle size of 1 μm, dysprosium fluoride having an average particle size of 5 μm and ethanol were mixed in a weight fraction of 25%, 25% and 50%, in which the magnet body was immersed for one minute with ultrasonic waves being applied. The magnet body was pulled up and immediately dried with hot air. At this point, the dysprosium oxide and dysprosium fluoride occupied a space spaced from the magnet surface at an average distance of 15 μm, and the filling factor was 50% by volume. The magnet body under powder coverage was subjected to absorption treatment by heating at 840° C. for one hour in an Ar atmosphere. It was ultrasonically washed with ethanol and dried, yielding a magnet body, designated magnet body M8, having an average crystal grain size of 0.52 μm.

Magnet bodies M8 and P5 were measured for magnetic properties, which are shown in Table 2. The treatment procedure of the invention contributes to an increase of coercive force $H_{cJ}$ of 300 $kAm^{-1}$.

Example 9 and Comparative Example 6

The sintered magnet body in Example 3 was subjected to HDDR treatment according to the schedule schematically shown in FIG. 1. It was ultrasonically washed with ethyl alcohol, and dried, yielding a magnet body P6.

Subsequently, terbium fluoride having an average particle size of 5 μm was mixed with ethanol at a weight fraction of 50%, in which the magnet body was immersed for one minute with ultrasonic waves being applied. The magnet body was pulled up and immediately dried with hot air. At this point, the terbium fluoride powder occupied a space spaced from the magnet surface at an average distance of 10 μm, and the filling factor was 45% by volume. The magnet body under powder coverage was subjected to absorption treatment by heating at 840° C. for one hour in an Ar atmosphere. It was ultrasonically washed with ethanol and dried, yielding a magnet body, designated M9, having an average crystal grain size of 0.43 μm.

Magnet bodies M9 and P6 were measured for magnetic properties, which are shown in Table 2. The treatment procedure of the invention contributes to an increase of coercive force $H_{cJ}$ of 650 $kAm^{-1}$.

Example 10

The magnet body M9 in Example 9 was successively washed with alkaline solution, deionized water, acid and deionized water, and dried. The resulting magnet body within the scope of the invention is designated M10.

Magnetic properties of magnet body M10 are shown in Table 2. It is seen that the magnet body exhibits high magnetic properties even when the heat treatment is followed by the washing step.

Examples 11 and 12

Using the same composition and procedure as in Example 9, a sintered block of 10 mm×20 mm×15 mm thick was prepared. Using an outer blade cutter, the sintered block was machined on all the surfaces into a rectangular parallelepiped body of the predetermined dimensions having a specific surface area S/V of 6 $mm^{-1}$.

The sintered body as machined was successively washed with alkaline solution, deionized water, acid and deionized water, and dried. The sintered magnet body was subjected to HDDR treatment according to the schedule schematically shown in FIG. 1. It was ultrasonically washed with ethyl alcohol, and dried, yielding a magnet body.

Subsequently, terbium fluoride having an average particle size of 5 μm was mixed with ethanol at a weight fraction of 50%, in which the magnet body was immersed for one minute with ultrasonic waves being applied. The magnet body was pulled up and immediately dried with hot air. At this point, the terbium fluoride powder occupied a space spaced from the magnet surface at an average distance of 10 μm, and the filling factor was 45% by volume. The magnet body under powder coverage was subjected to absorption treatment by heating at 840° C. for one hour in an Ar atmosphere. It was ultrasonically washed with ethanol and dried, yielding a magnet body. Using an inner blade cutter, the magnet body was machined into a rectangular parallelepiped body of the predetermined dimensions having a specific surface area S/V of 36 $mm^{-1}$. The resulting magnet body within the scope of the invention, designated M11, had an average crystal grain size of 0.47 μm.

The magnet body was subjected to electroless copper/nickel plating, obtaining a magnet body M12 within the scope of the invention.

Magnet bodies M11 and M12 were measured for magnetic properties, which are shown in Table 2. The magnet bodies which were machined and further plated after the HDDR treatment exhibited equivalent magnetic properties to magnet body M9 which was machined to an ultra-compact shape having a specific surface area S/V of 36 $mm^{-1}$ in advance of the heat treatment.

TABLE 2

| | Designation | $B_r$ [T] | $H_{cJ}$ [$kAm^{-1}$] | $(BH)_{max}$ [$kJ/m^{-3}$] |
|---|---|---|---|---|
| Example 7 | M7 | 1.34 | 1230 | 345 |
| Example 8 | M8 | 1.34 | 1180 | 340 |
| Example 9 | M9 | 1.38 | 1460 | 370 |
| Example 10 | M10 | 1.38 | 1460 | 370 |
| Example 11 | M11 | 1.37 | 1455 | 365 |
| Example 12 | M12 | 1.37 | 1455 | 365 |
| Comparative Example 4 | P4 | 1.34 | 880 | 345 |
| Comparative Example 5 | P5 | 1.34 | 880 | 340 |
| Comparative Example 6 | P6 | 1.38 | 810 | 370 |

Japanese Patent Application Nos. 2006-112327 and 2006-112342 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a permanent magnet material, comprising the steps of:

providing an anisotropic sintered magnet body having the compositional formula: $R^1_x(Fe_{1-y}Co_y)_{100-x-z-a}B_zM_a$ wherein $R^1$ is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R^1{}_2Fe_{14}B$ compound as a primary phase, machining the magnet body to a specific surface area of at least 6 $mm^{-1}$, disposing on a surface of the machined magnet body a powder comprising at least one of an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and having an average particle size equal to or less than 100 μm, wherein $R^2$, $R^3$, or $R^4$ contains at least 10 atom % of Dy and/or Tb, and the total concentration of Nd and Pr in $R^2$, $R^3$ or $R^4$ is lower than the total concentration of Nd and Pr in $R^1$, heat treating the machined magnet body having the powder disposed on its surface in a hydrogen gas-containing atmosphere at 600 to 1,100° C. for inducing disproportionation reaction on the $R^1{}_2Fe_{14}B$ compound, and continuing heat treatment in an atmosphere having a reduced hydrogen gas partial pressure at 600 to 1,100° C. for inducing recombination reaction to the $R^1{}_2Fe_{14}B$ compound, thereby finely dividing the $R^1{}_2Fe_{14}B$ compound phase to a crystal grain size equal to or less than 1 μm, and for effecting absorption treatment, thereby causing at least one of $R^2$, $R^3$, and $R^4$ in the powder to be absorbed in the magnet body.

2. The method of claim 1, wherein said powder is disposed on the magnet body surface in an amount corresponding to an average filling factor of at least 10% by volume in a magnet body-surrounding space at a distance equal to or less than 1 mm from the magnet body surface.

3. A method for preparing a permanent magnet material, comprising the steps of:

providing an anisotropic sintered magnet body having the compositional formula: $R^1{}_x(Fe_{1-y}Co_y)_{100-x-z-a}B_zM_a$ wherein $R^1$ is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R^1{}_2Fe_{14}B$ compound as a primary phase, machining the magnet body to a specific surface area of at least 6 $mm^{-1}$, disposing on a surface of the machined magnet body a powder comprising at least one of an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and having an average particle size equal to or less than 100 μm, wherein said powder comprises at least 40% by weight of the fluoride of $R^3$ and/or the oxyfluoride of $R^4$, with the balance containing at least one member selected from the group consisting of the oxide of $R^2$ and a carbide, nitride, oxide, hydroxide, and hydride of $R^5$ wherein $R^5$ is at least one element selected from rare earth elements inclusive of Sc and Y, heat treating the machined magnet body having the powder disposed on its surface in a hydrogen gas-containing atmosphere at 600 to 1,100° C. for inducing disproportionation reaction on the $R^1{}_2Fe_{14}B$ compound, and continuing heat treatment in an atmosphere having a reduced hydrogen gas partial pressure at 600 to 1,100° C. for inducing recombination reaction to the $R^1{}_2Fe_{14}B$ compound, thereby finely dividing the $R^1{}_2Fe_{14}B$ compound phase to a crystal grain size equal to or less than 1 μm, and for effecting absorption treatment, thereby causing at least one of $R^2$, $R^3$, and $R^4$ in the powder to be absorbed in the magnet body.

4. The method of claim 3, wherein said powder comprises the fluoride of $R^3$ and/or the oxyfluoride of $R^4$, and the absorption treatment causes fluorine in the powder to be absorbed in the magnet body.

5. The method of claim 1, further comprising, prior to the disposing step, washing the machined magnet body with at least one agent selected from alkalis, acids, and organic solvents.

6. The method of claim 1, further comprising, prior to the disposing step, shot blasting the machined magnet body for removing a surface affected layer.

7. The method of claim 1, further comprising washing the machined magnet body with at least one agent selected from alkalis, acids, and organic solvents after the heat treatment in an atmosphere having a reduced hydrogen gas partial pressure.

8. The method of claim 1, further comprising machining the magnet body after the heat treatment in an atmosphere having a reduced hydrogen gas partial pressure.

9. The method of claim 1, further comprising plating or coating the magnet body after the heat treatment in an atmosphere having a reduced hydrogen gas partial pressure.

10. A method for preparing a permanent magnet material, comprising the steps of:

providing an anisotropic sintered magnet body having the compositional formula: $R^1{}_x(Fe_{1-y}Co_y)_{100-x-z-a}B_zM_a$ wherein $R^1$ is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R^1{}_2Fe_{14}B$ compound as a primary phase, machining the magnet body to a specific surface area of at least 6 $mm^{-1}$, heat treating the machined magnet body in a hydrogen gas-containing atmosphere at 600 to 1,100° C. for inducing disproportionation reaction on the $R^1{}_2Fe_{14}B$ compound, continuing heat treatment in an atmosphere having a reduced hydrogen gas partial pressure at 600 to 1,100° C. for inducing recombination reaction to the $R^1{}_2Fe_{14}B$ compound, thereby finely dividing the $R^1{}_2Fe_{14}B$ compound phase to a crystal grain size equal to or less than 1 μm, followed by disposing on a surface of the magnet body a powder comprising at least one of an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and having an average particle size equal to or less than 100 μm, wherein $R^2$, $R^3$, or $R^4$ contains at least 10 atom % of Dy and/or Tb, and the total concentration of Nd and Pr in $R^2$, $R^3$ or $R^4$ is lower than the total concentration of Nd and Pr in $R^1$, heat treating the magnet body having the powder disposed on its surface at a temperature equal to or below the temperature of said heat treatment in an atmosphere having a reduced hydrogen gas partial pressure, in vacuum or in an inert gas, for absorption treatment, thereby causing at least one of $R^2$, $R^3$, and $R^4$ in the powder to be absorbed in the magnet body.

11. The method of claim 10, wherein said powder is disposed on the magnet body surface in an amount corresponding to an average filling factor of at least 10% by volume in a magnet body-surrounding space at a distance equal to or less than 1 mm from the magnet body surface.

12. A method for preparing a permanent magnet material, comprising the steps of:

providing an anisotropic sintered magnet body having the compositional formula: $R^1_x(Fe_{1-y}Co_y)_{100-x-z-a}B_zM_a$ wherein $R^1$ is at least one element selected from rare earth elements inclusive of Sc and Y, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, x, y, z, and a indicative of atomic percentage are in the range: $10 \leqq x \leqq 15$, $0 \leqq y \leqq 0.4$, $3 \leqq z \leqq 15$, and $0 \leqq a \leqq 11$, said magnet body containing a $R^1_2Fe_{14}B$ compound as a primary phase, machining the magnet body to a specific surface area of at least 6 $mm^{-1}$, heat treating the machined magnet body in a hydrogen gas-containing atmosphere at 600 to 1,100° C. for inducing disproportionation reaction on the $R^1_2Fe_{14}B$ compound, continuing heat treatment in an atmosphere having a reduced hydrogen gas partial pressure at 600 to 1,100° C. for inducing recombination reaction to the $R^1_2Fe_{14}B$ compound, thereby finely dividing the $R^1_2Fe_{14}B$ compound phase to a crystal grain size equal to or less than 1 μm, followed by disposing on a surface of the magnet body a powder comprising at least one of an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and having an average particle size equal to or less than 100 μm, wherein said powder comprises at least 40% by weight of the fluoride of $R^3$ and/or the oxyfluoride of $R^4$, with the balance containing at least one member selected from the group consisting of the oxide of $R^2$ and a carbide, nitride, oxide, hydroxide, and hydride of $R^5$ wherein $R^5$ is at least one element selected from rare earth elements inclusive of Sc and Y, heat treating the magnet body having the powder disposed on its surface at a temperature equal to or below the temperature of said heat treatment in an atmosphere having a reduced hydrogen gas partial pressure, in vacuum or in an inert gas, for absorption treatment, thereby causing at least one of $R^2$, $R^3$, and $R^4$ in the powder to be absorbed in the magnet body.

13. The method of claim 12, wherein said powder comprises the fluoride of $R^3$ and/or the oxyfluoride of $R^4$, and the absorption treatment causes fluorine in the powder to be absorbed in the magnet body.

14. The method of claim 10, further comprising, prior to the disproportionation reaction treatment, washing the machined magnet body with at least one agent selected from alkalis, acids, and organic solvents.

15. The method of claim 10, further comprising, prior to the disproportionation reaction treatment, shot blasting the machined magnet body for removing a surface affected layer.

16. The method of claim 10, further comprising washing the machined magnet body with at least one agent selected from alkalis, acids, and organic solvents after the absorption treatment.

17. The method of claim 10, further comprising machining the magnet body after the absorption treatment.

18. The method of claim 10, further comprising plating or coating the magnet body after the absorption treatment.

19. The method of claim 7, further comprising plating or coating the magnet body after the alkali, acid or organic solvent washing step following the heat treatment in an atmosphere having a reduced hydrogen gas partial pressure.

20. The method of claim 1, further comprising a machining step following the heat treatment in an atmosphere having a reduced hydrogen gas partial pressure for inducing recombination reaction and plating or coating the magnet body after the machining step following the heat treatment in an atmosphere having a reduced hydrogen gas partial pressure for inducing recombination reaction.

21. The method of claim 16, further comprising the alkali, acid or organic solvent washing step following the absorption treatment and plating or coating the magnet body after the washing step.

22. The method of claim 10 further comprising a machining step following the absorption treatment and plating or coating the magnet body after the machining step following the absorption treatment.

23. The method of claim 3, further comprising machining the magnet body after the heat treatment in an atmosphere having a reduced hydrogen gas partial pressure.

24. The method of claim 12, further comprising a machining step following the absorption treatment and plating or coating the magnet body after the machining step following the absorption treatment.

* * * * *